United States Patent [19]

Wang

[11] Patent Number: 4,493,670

[45] Date of Patent: Jan. 15, 1985

[54] SIMULTANEOUS FOLLOWING MEANS FOR DRIVER AND FOLLOWER IN A TOY CAR

[76] Inventor: Ta-Lung Wang, 1st Fl., No. 27, Lane 432, Wu-Hsing St., Taipei, Taiwan

[21] Appl. No.: 563,697

[22] Filed: Dec. 21, 1983

[51] Int. Cl.[3] ..... A63H 17/25

[52] U.S. Cl. ..... 446/288

[58] Field of Search ..... 46/107, 202, 106, 181, 46/97

[56] References Cited

U.S. PATENT DOCUMENTS 2,487,940 11/1949 Pacheco ..... 46/107

2,603,913 7/1952 Ernst ..... 46/107 X 2,885,823 5/1959 Smith, Jr. ..... 46/107

*Primary Examiner*—Mickey Yu

*Attorney, Agent, or Firm*—Cushman, Darby & Cushman

[57] ABSTRACT

A simultaneous following device for driver and follower in a toy car which transmit the kinetic energy generated by a drive via an eccentric wheel and link and double bar-oscillating arm so that the two bars of the double bar-oscillating arm are swinging and thus to drive the spindles of the steering wheel and the follower for rotation in normal/reverse direction at a small degree so that the steering wheel and the follower are swung simultaneously to show the driving operation of the driver and the action of the follower.

2 Claims, 5 Drawing Figures

SIMULTANEOUS FOLLOWING MEANS FOR DRIVER AND FOLLOWER IN A TOY CAR

BACKGROUND OF THE INVENTION

On toy cars available now, movable arms of the driver are normally placed on the steering wheel so that it looks like the arms are controlling the steering wheel while the steering wheel is rotated. However, most of the toy cars do not have a follower mechanism or the follower is sitting still while the steering wheel is rotated.

An objective of the present invention is to provide a simple following means so that the follower can swing simultaneously following the driving operation of the driver.

Of course, to attain the above purpose, two sets of driving means which drive the steering wheel can be equipped. However, in such case, the structure will be very complicated and the possibility of trouble on the toy car will be high.

The following means as provided by the present invention mainly comprises a doll pair, a driving means, a linkage transmission mechanism and a following mechanism. By the transmission and change of path of motion by the linkage transmission mechanism and the following mechanism, the steering wheel and the body of a follower in a toy car can rotate simultaneously. It is not only simple in structure, but also provides more function to a toy car.

SUMMARY OF THE INVENTION

The invention relates to a mechanical design of a toy car, particularly a following means which can effect a driving operation of the driver and swinging action of the follower so as to occur simultaneously. By transmission of kinetic energy generated by a driving means and changing of path of motion by a linkage transmission mechanism and a following mechanism, the device of this invention drives the spindles of the steering wheel and the follower for swinging in order to achieve the above purpose of following action. The device characterized by its novel and simple sturcture whereby it can swing the body of follower following the driving operation of the driver in order to show the action of the follower and to improve the function and fun of playing with the toy car.

DETAILED DESCRIPTION

Figure 1:
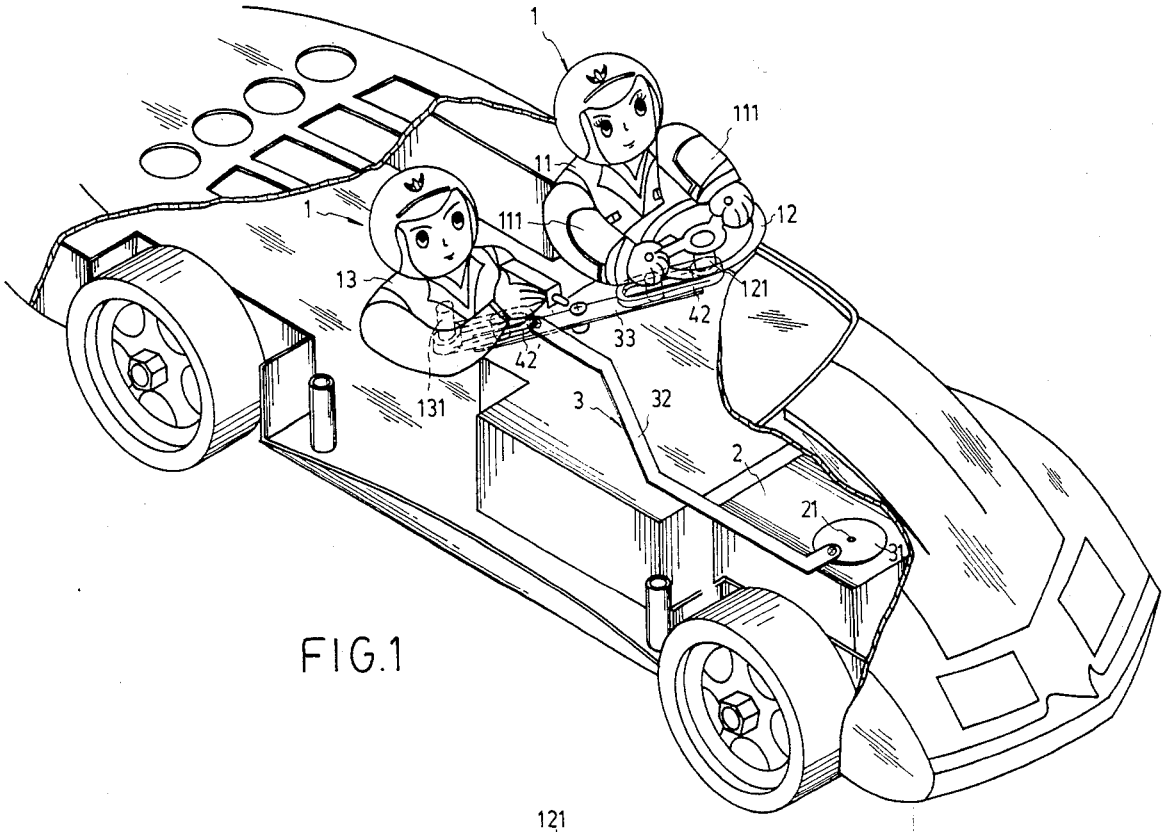
FIG. 1 is a perspective view of a police toy car, a preferred embodiment of the present invention.

A detailed description of a preferred embodiment of the present invention with reference to the attached drawings is as follows:

Referring to the FIG. 1, in perspective view of a police toy car, a preferred embodiment of the present invention is shown comprising mainly doll pair (1), a driving means (2), a linkage transmission mechanism (3) and a following mechanism (4).

Figure 2:
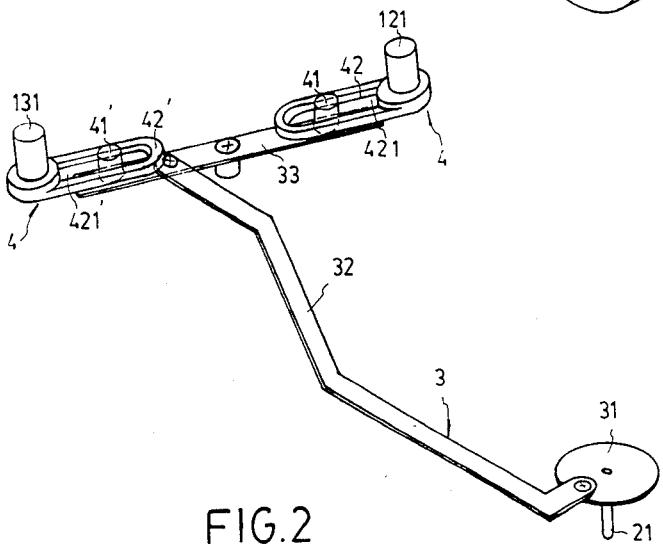
FIG. 2 shows the structure of the linkage transmission mechanism and following mechanism according to the preferred embodiment of the present invention.

Please refer to the FIG. 2 which illustrates the structure of the linkage transmission mechanism (3) and following mechanism (4) as shown in the FIG. 1. The main parts in the FIG. 1 and the FIG. 2 are described as follows:

1. Doll Pair (1): The Doll Pair (1) is composed of a driver (11), a follower (13) sitting in the car and a steering wheel (12) operated by the driver (11). The driver (11) has two movable arms (111) with knuckle joint respectively. The arms (111) are placed on the steering wheel (12) and give an appearance of driving while the steering wheel (12) is rotated. The follower (13) is holding a gun to give a sense of shooting while rotating. The said steeing wheel (12) has a spindle (121) at the center of its bottom, and the said follower (13) has a spindle (131) at the center of its bottom too. The spindles pass through the shell of the car to its interior for rotating upon receipt of kinetic energy.

2. Driving Means (2): The driving means (2) provides kinetic energy at low speed to rotate the said steering wheel (12) and the said follower (13) via the linkage transmission mechanism (3) and the following mechanism (4). The driving means (2) can be made of an ordinary motor and a set of reduction gears, or just a low speed motor with an output shaft (21) coupling the linkage transmission mechanism (3).

3. Linkage Transmission Mechanism (3): The linkage transmisson mechanism (3) comprises an eccentric wheel (31) (or a crank as a substitute), a link (32), double bar-oscillating arm (33) etc., wherein the eccentric wheel (31) is coupled with the output shaft (21) of the driving means (2) and drives the link (32) for linear reciprocating movement while the output shaft (21) is rotating and thus, drives the two bars of the double bar-oscillating arm (33) for continuous swinging.

4. Following Mechanism (4): The following mechanism (4) follows the swinging of the said double bar-oscillating arms (33) to drive the said steering wheel (12) and the follower (13) for simultaneous rotation. It comprises rods (41) (41') on the two bars on the double bar-oscillating arm (33) respectively. Ends of the spindles (121) (131) of the steering wheel (12) and the follower (13) are fixed to the sliding guided oscillating elements (42) (42') respectively. The said rods (41) (41') are placed within the sliding guides (421) (421') of the sliding guided oscillating elements (42) (42') and there are spaces in the sliding guides (421 ) (421') respectively for their movements in the sliding guides (421) (421') respectively. While the said double bar-oscillating arm (33) of the linkage transmission mechanism (3) is swinging, the rods (41) (41') drive the sliding guided oscillating elements (42) (42') for simultaneous swinging and at the same time, by the movements of the rods (41) (41') within the sliding guides (421) (421'), the spindles (121) (131) are rotated in the normal or reverse direction for a small degree with their centers as pivots respectively according to the degree of swinging of the sliding guided oscillating elements (42) (42') and thus, the steering wheel (12) and the follower (13) swing respectively.

Figure 3:
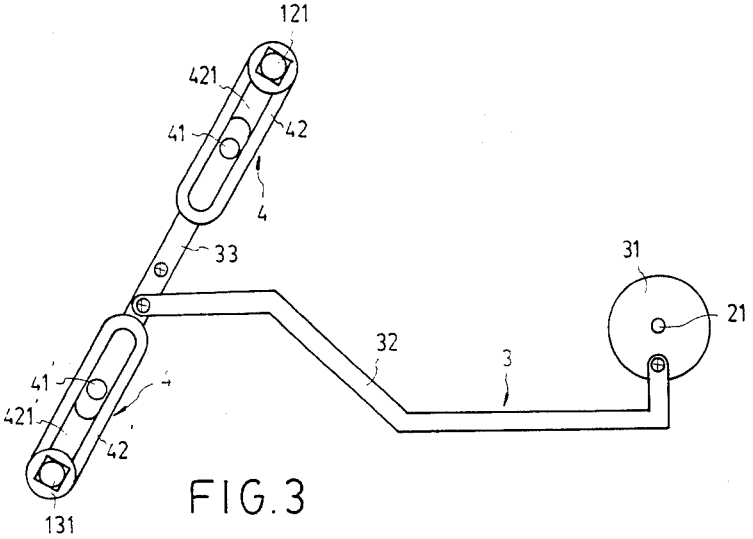
FIGS. 3, 4 and 5 illustrate movement in the preferred embodiment of the present invention.
Figure 4:
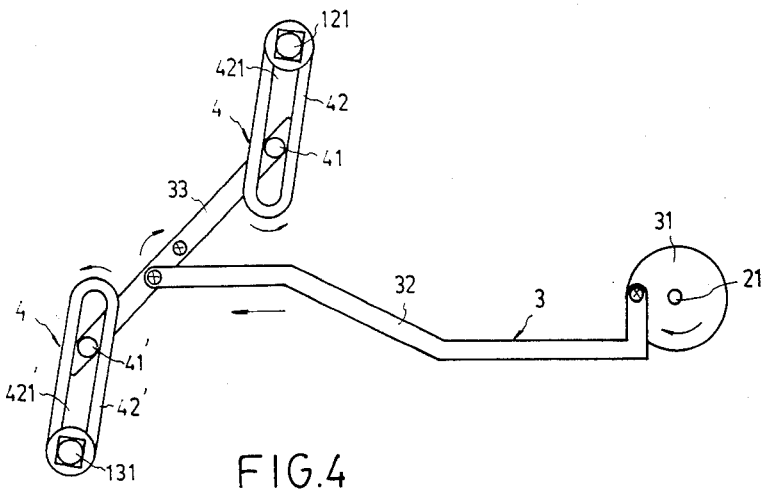
Figure 5:
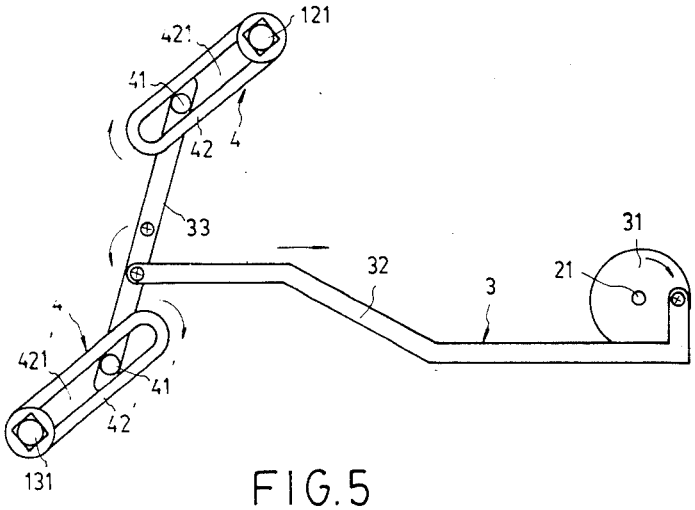

The FIG. 3, FIG. 4 and FIG. 5 illustrate the path of motion in the linkage transmission mechanism (3) and the following mechanism (4), which clearly show the continuous movements of the linkage transmission mechanism (3) to drive the following mechanism (4).

I claim:

1. A simultaneous following means for driver and follower in a toy car comprising:

a doll pair comprised of a driver, a steering wheel and a follower wherein the movable arms of the driver are placed on the steering wheel and there is a spindle at the center of the bottom of the steering wheel and the follower respectively passing through the shell of the car to the interior of the car;

a driving means which generate kinetic energy output at low speed;

a linkage transmission mechanism comprised of an eccentic wheel, a link and a double bar-oscillating arm to transmit the kinetic energy generated by the driving means to the double bar-oscillating arm for swinging said arm; and a following mechanism which upon the swinging of the said double bar-oscillating arm, drive the spindles of the steering wheel and the follower for rotation in normal or reverse direction at a small degree to cause the steering wheel and follower for simultaneous swinging.

2. A simultaneous following means for driver and follower is a toy car as claimed in the claim 1, wherein the following mechanism is comprised of two rods on the end of the double bar-oscillating arm and two sliding guided oscillating elements fixed to the lower ends of the spindles for the steering wheel and the follower respectively with an arrangement that the rods are placed within the sliding guides of the sliding guided oscillating elements so that while the double bar-oscillating arm is swinging, the rods drive the sliding guided oscillating elements for swinging simultaneously and by the movement of the rods in the sliding guides, the steering wheel and the follower, with their respective spindle as center, rotate in the normal or reverse direction to a small degree according to the position of the sliding guided oscillating elements.

* * * * *